US010225894B2

(12) United States Patent
Yu

(10) Patent No.: US 10,225,894 B2
(45) Date of Patent: Mar. 5, 2019

(54) ELECTRICAL LOAD DRIVING DEVICE

(71) Applicant: Sang-Woo Yu, Seongnam-si (KR)

(72) Inventor: Sang-Woo Yu, Seongnam-si (KR)

(73) Assignee: Sang-Woo Yu, Seongnam-Si (KR)

( * ) Notice: Subject to any disclaimer, the term of this patent is extended or adjusted under 35 U.S.C. 154(b) by 0 days.

(21) Appl. No.: 15/116,944

(22) PCT Filed: Jul. 21, 2015

(86) PCT No.: PCT/KR2015/007530
§ 371 (c)(1),
(2) Date: Aug. 5, 2016

(87) PCT Pub. No.: WO2016/013839
PCT Pub. Date: Jan. 28, 2016

(65) Prior Publication Data

US 2017/0171923 A1 Jun. 15, 2017

(30) Foreign Application Priority Data

Aug. 20, 2014 (KR) ..... 10-2014-0108435

(51) Int. Cl.
*H05B 33/08* (2006.01)

(52) U.S. Cl.
CPC ..... *H05B 33/0812* (2013.01); *H05B 33/089* (2013.01); *H05B 33/0815* (2013.01)

(58) Field of Classification Search
CPC ..... H05B 33/0815; H05B 33/0845; H05B 33/0809; H05B 33/0803; H05B 33/0818;
(Continued)

(56) References Cited

U.S. PATENT DOCUMENTS 9,426,855 B2 * 8/2016 Lee ..... H05B 33/0824
2011/0193491 A1 * 8/2011 Choutov ..... H05B 33/0803 315/291

(Continued)

FOREIGN PATENT DOCUMENTS

| | | |
|---|---|---|
| JP | 2011040701 | 2/2011 |
| KR | 1019990015508 | 3/1999 |
| KR | 20140093015 | 7/2014 |

OTHER PUBLICATIONS

Author: Afroz M.Iman, Title:Condition Monitoring of Electrolytic Capacitors for Power Electronics Applications, Date:May 1, 2007.*

(Continued)

*Primary Examiner* — Wei Chan
(74) *Attorney, Agent, or Firm* — Cantor Colburn LLP

(57) ABSTRACT

Provided is an electrical load driving device including an SMPS (switching mode power supply). The electrical load driving device comprises: a rectifying unit configured to rectify a current on an output path of the SMPS; a current limiting unit configured to limit the current output from the rectifying unit to a value equal to or less than a predetermined magnitude; a smoothing unit configured to supply a power to a load by smoothing a current output from the current limiting unit; and a floating prevention unit configured to be installed between an output terminal of the rectifying unit and an input terminal of the current limiting unit and to prevent an output of the rectifying unit from floating when the current limiting unit is interrupted.

5 Claims, 4 Drawing Sheets

(58) Field of Classification Search
CPC .. H05B 37/02; H05B 33/0851; H05B 33/089; H05B 41/2806; H05B 33/0887; H05B 33/0842
USPC ..... 315/200 R, 85, 186, 224, 291, 294, 307, 315/34
See application file for complete search history.

(56) References Cited

U.S. PATENT DOCUMENTS

| | | | | |
|---|---|---|---|---|
| 2011/0234479 | A1* | 9/2011 | Han | H05B 37/0227 345/102 |
| 2011/0266969 | A1* | 11/2011 | Ludorf | H02M 1/4258 315/294 |
| 2011/0278606 | A1* | 11/2011 | Suzuki | H01L 25/0753 257/89 |
| 2012/0106216 | A1* | 5/2012 | Tzinker | H02M 1/4225 363/126 |
| 2012/0248998 | A1* | 10/2012 | Yoshinaga | H05B 33/0815 315/193 |
| 2014/0015443 | A1* | 1/2014 | Nakajo | H05B 33/0896 315/297 |
| 2014/0253842 | A1* | 9/2014 | Zhang | G09G 3/3406 349/62 |

OTHER PUBLICATIONS

International Search Report—PCT/KR2015/007530 dated Oct. 23, 2015.

* cited by examiner

ELECTRICAL LOAD DRIVING DEVICE

TECHNICAL FIELD

The present disclosure in some embodiments relates to a device for driving an electrical load such as an LED (Light Emitting Diode). More particularly, some embodiments of the present disclosure relate to an electrical load driving device of the SMPS (Switching Mode Power Supply) type, which is used for LED lighting equipment and is provided with a failure protection circuit for an electrolytic capacitor.

BACKGROUND

Alternating current (AC) power supplies are generally classified into an SMPS system and a linear power supply system, of which the SMPS method is mainly used in most applications including consumer electronics, computer, and communication equipment The rapid surge of demand for LED lighting has encouraged extensive development efforts toward LED lighting using an SMPS device.

The LED has a low driving voltage (Vf) which requires an increase of the drive current (If) to manufacture a high-output lighting equipment that will also be desirable with less flickering. Therefore, such an LED lighting equipment needs to have a high-capacitance capacitor at its output end.

However, the LED illuminates with about 15% of the power consumption and turns approximately 85% of remaining power to thermal energy, resulting in a sudden rise in ambient temperature.

Moreover, there is a size restriction to a smaller lighting equipment that needs to accommodate mounting of all the LEDs and the power supply circuit such as the SMPS, which generate heat leading to malfunctions thereof, as realized by recent product recalls in the United States and Japan due to resultant fires, electric shocks, and the like.

In addition, such heat radiation is responsible for reducing the SMPS lifespan as short as less than 20,000 hours against the LED lifetime of approximately 35,000 hours. According to a U.S. Department of Energy: DOE's 2012 report, approximately ¼ of the LED lighting equipment sold in the US breaks within 1,000 hours of operation time, and the majority of these failures are known to occur in electrolytic capacitors of the SMPS.

There have been attempts to resolve the above-mentioned faults by designing SMPS and LED to be isolated from each other or using a solid capacitor instead of the electrolytic capacitor and the like. However, such known solutions are intolerant of some difficult conditions, failing to achieve an appreciable improvement in the SMPS lifespan and are too costly to realize a commercialization.

DISCLOSURE

Technical Problem

Therefore, the present disclosure in some embodiments seeks to provide an electrical load driving device which can prolong the life of the SMPS beyond the life of the electrical load such as an LED component, even at a high temperature environment caused by the electrical load LED-generated heat.

SUMMARY

In accordance with some embodiments of the present disclosure, an electrical load driving device with an SMPS (switching mode power supply) includes a rectifying unit, a current limiting unit and a smoothing unit. The rectifying unit is configured to rectify a current on an output path of the SMPS. The current limiting unit is configured to limit the current output from the rectifying unit to a value equal to or less than a predetermined magnitude. The smoothing unit is configured to supply a power to a load by smoothing a current output from the current limiting unit. The current limiting unit provides a current value inputted from the rectifying unit by limiting the current value not to exceed a maximum allowable ripple current of the smoothing unit, as an input to the smoothing unit.

In accordance with some embodiments of the present disclosure, an electrical load driving device further includes a floating prevention unit configured to be installed between an output terminal of the rectifying unit and an input terminal of the current limiting unit and to prevent an output of the rectifying unit from floating when the current limiting unit is interrupted.

According to some embodiments of the present disclosure, the smoothing unit includes an electrolytic capacitor and the floating prevention unit includes a film capacitor which has one terminal connected between the output terminal of the rectifying unit and the current limiting unit, and the other terminal grounded, with the current limiting unit being connected in series between the output terminal of the rectifying unit and an input terminal of the smoothing unit.

According to some embodiments of the present disclosure, the current limiting unit includes one or more current limiting units connected in parallel with each other at the output terminal of the rectifying unit, the smoothing unit includes one or more smoothing units respectively connected to the one or more current limiting units, and the load includes one or more loads respectively connected to the one or more smoothing units.

DETAILED DESCRIPTION

Figure 1:
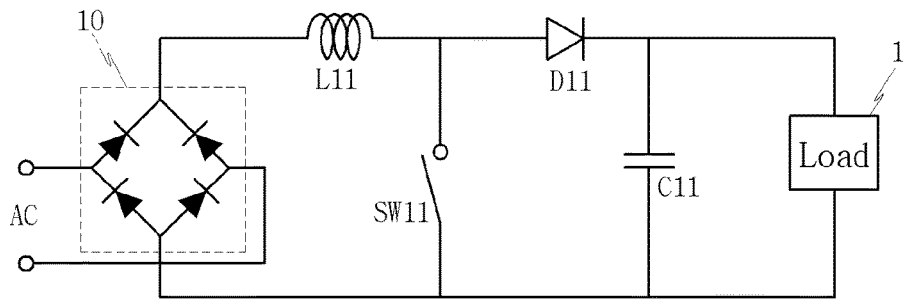
FIG. 1 is a circuit diagram of a typical boost SMPS.

Hereinafter, at least one embodiment of the present disclosure will be described in detail with reference to the accompanying drawings. In the following description, like reference numerals designate like elements, although the elements are shown in different drawings. Further, in the following description of the at least one embodiment, a detailed description of known functions and configurations incorporated herein will be omitted for the purpose of clarity and for brevity.

Conventional SMPS is typically classified into boost topology SMPS and buck topology SMPS.

FIG. 1 is a circuit diagram of a typical boost SMPS which may include a full-wave bridge rectifier 10, an inductor L11, a switch SW11, a diode D11 and a capacitor C11.

When switch SW11 is turned on, current flows through rectifier 10, inductor L11, switch SW11 and rectifier 10 in this order to accumulate energy in inductor L11. Turning off switch SW11 releases the energy stored in inductor L11 to flow through diode D11, capacitor C11 and switch SW11, wherein the polarity of energy is the reverse of the input current. Such reversal of current upon breaking it after certain duration is called the counter-electromotive force or back electromotive force, which is accompanied by an instantaneous but consequential voltage rise maintained for quite a long time due to the phenomenon of self-induction that occurs in the coil.

Prior to supplying to a load 1, the thus formed output voltage undergoes a rectification stage by diode D11 for extracting the component of the current followed by a smoothing stage by capacitor C11.

As described above, switch SW11 is periodically turned on/off to generate a pulsed direct-current voltage and supply the same to load 1.

Figure 2:
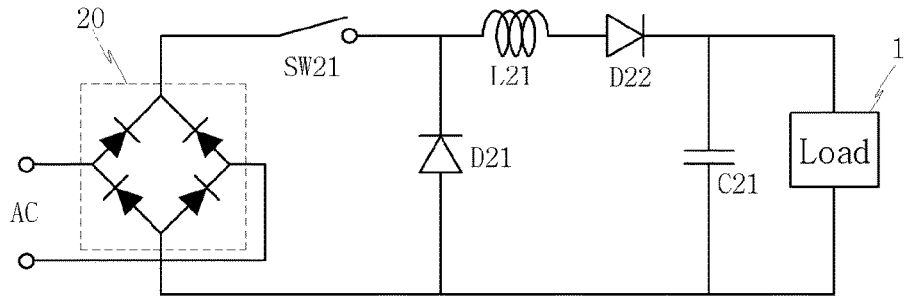
FIG. 2 is a circuit diagram of a typical buck SMPS.

FIG. 2 is a circuit diagram of a typical step-down or buck SMPS which may include a full-wave bridge rectifier 20, a switch SW21, a diode D21, an inductor L21, diode D22 and a capacitor C21.

When switch SW21 is turned on, current flows to inductor L21 where energy is accumulated or stored and then rectified by diode D22 until it is delivered to capacitor C21 and load 1, whereby generating an increased amount of current to flow.

When the switch SW21 is turned off, the diode D21 establishes a passage for an inductor current that is the energy stored in the inductor L21 to receive a rectification by diode D22 and then flow through capacitor C21 and load 1 with the quantity of the inductor current decreasing until switch SW21 is turned back on.

In this way, switch SW21 is periodically turned on/off to generate a pulsed direct-current voltage for supplying to load.

In order to power load 1 in the SMPS of FIGS. 1 and 2, the typical SMPS utilizes electrolytic capacitors C11, C21 for storing electric power that has passed through the inductor by the switching operation. However, electrolytic capacitors C11 and C21 are susceptible to shortened life and failures under different conditions such as an external temperature, applied voltage, ripple current, charge and discharge pattern, inrush current and abnormal voltage.

As in the two example circuits shown in FIGS. 1 and 2, the conventional SMPS checks the output voltage and, depending on the check result, performs the on/off switching of switches SW11, SW21 to regulate the output voltage at a constant level.

However, in case where load 1 is an LED, a 1° C. rise in temperature reduces driving voltage Vf by about 2 mV-5 mV which is equivalent to that amount of rise in the applied voltage to increase the current flowing through LED load 1. When the applied voltage is increased by about 10%, the current flowing through LED load 1 would be increased 50% to 100%.

In case of an LED light bulb, the internal temperature rises to about 85° C. which is a whopping 60° C. jump over room temperature 25° C., to cause the thermal runaway and consumes greater current than designed. This in turn generates greater ripple current in electrolytic capacitors C11, C21 than the designed tolerance to cause failure of electrolytic capacitors C11, C21.

Figure 3:
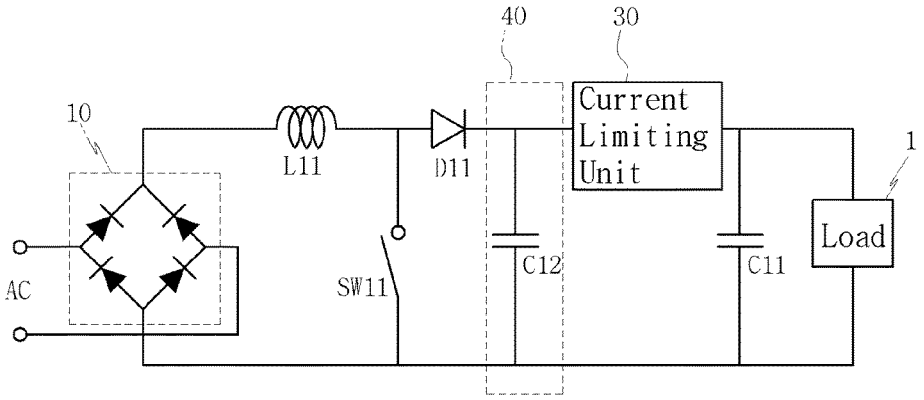
FIG. 3 is a circuit diagram of an electrical load driving device according to at least one embodiment of the present disclosure.
Figure 4:
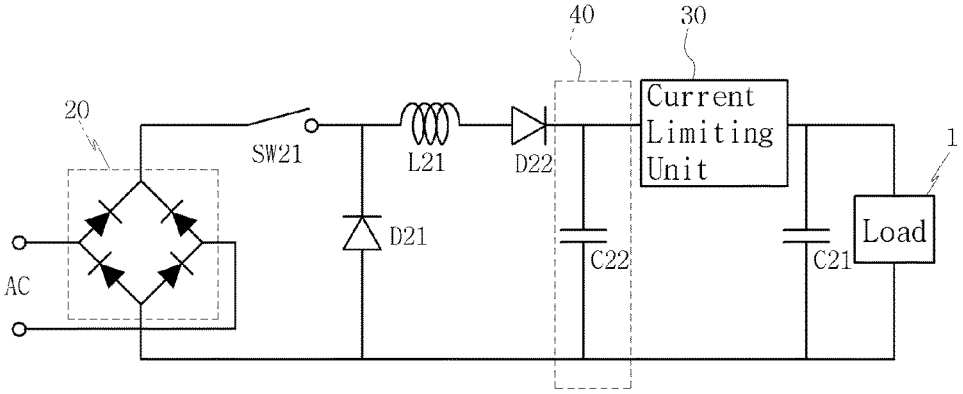
FIG. 4 is a circuit diagram of an electrical load driving device according to another embodiment of the present disclosure.
Figure 5:
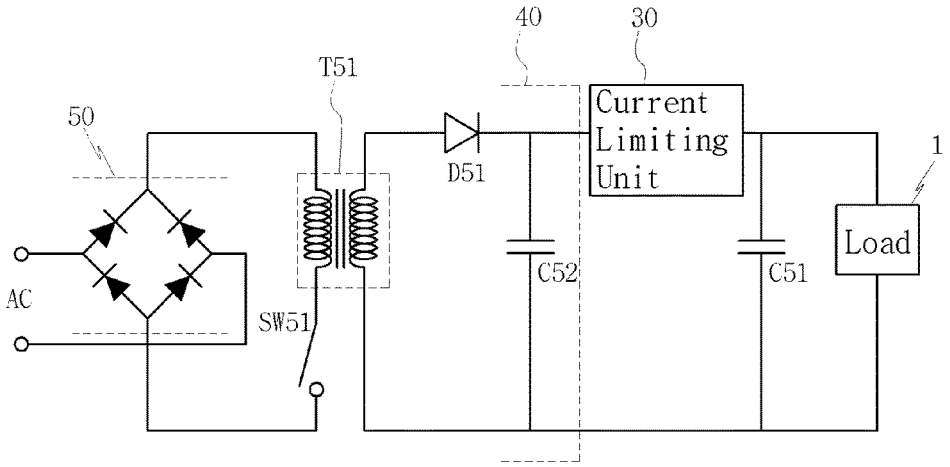
FIG. 5 is a circuit diagram of an electrical load driving device according to yet another embodiment of the present disclosure.

In order to prevent the ripple current runaway of the electrolytic capacitor due to thermal runaway of an electrical load such as the LED, some embodiments of the present disclosure provide circuits as shown in FIGS. 3 to 5.

An electrical load driving device according to some embodiments of the present disclosure is illustrated in a circuit diagram of FIG. 3 as applied to the boost SMPS of FIG. 1.

Further to the boost SMPS circuit of FIG. 1, the circuit shown in FIG. 3 includes a current limiting unit 30 between the input terminal of capacitor C11 serving as a smoothing unit and the output terminal of diode D11 serving as a rectifying unit for the current in the output path, and includes a capacitor C12 preventive of floating and for storing temporary energy (hereinafter referred to as a floating prevention unit) between the output terminal of the rectifying diode D11 and the input terminal of current limiting unit 30.

Capacitor C12 serves to temporarily store energy while preventing the output of the diode D11 from floating, when current limiting unit 30 is interrupted. Capacitor C12 has one end connected between the output terminal of diode D11 and the input terminal of current limiting unit 30, and the other end grounded. In some embodiments, capacitor C12 is, but not limited thereto, a film capacitor, and it may be a film capacitor with a very large ripple current tolerance to complement the electrolytic capacitor, or a ceramic capacitor where there is a tight space constraint.

In the embodiment of FIG. 3, current limiting unit 30 serves to provide the current output from the rectifying diode D11 with its magnitude limited to a predetermined level as an input to the smoothing capacitor C11. To this end, current limiting unit 30 limits a current value inputted from diode D11 from exceeding the maximum allowable ripple current value of capacitor C11 and provides the limited current as an input to capacitor C11.

In the embodiment of FIG. 3, current limiting unit 30 is configured to include a variable resistor operative to keep its output current from exceeding the maximum allowable ripple current of electrolytic capacitor C11, and load 1 includes an electrical load such as an LED, a charger, a refrigerator, an electric washing machine, etc.

Further, simply adding current limiting unit 30 to the embodiment of FIG. 3 may be vulnerable to an interruption to current limiting unit 30 that leads to floating of the output of the rectifying diode D11 and in turn a failure of feedback function which is necessary for switch SW11 to perform the on/off switching. As a preventive measure, film capacitor C12 may be inserted between the output terminal of the rectifying diode D11 and the input terminal of current limiting unit 30 to prevent the maloperation.

An electrical load driving device of FIG. 4 according to another embodiment of the present disclosure is illustrated in a circuit diagram as applied to the buck SMPS of FIG. 2.

Further to the buck SMPS circuit of FIG. 2, the circuit shown in FIG. 4 includes a current limiting unit 30 between the input terminal of the smoothing electrolytic capacitor C21 and the output terminal of the rectifying diode D21 for the current in the output path, and includes a capacitor C22 that serves as a floating prevention unit 40 between the output terminal of the rectifying diode D22 and the input terminal of current limiting unit 30.

Capacitor C22 in FIG. 4 serves to temporarily store energy while preventing the output of the diode D22 from floating, when current limiting unit 30 is interrupted. Capacitor C22 has one end connected between the output terminal of diode D22 and the input terminal of current limiting unit 30, and the other end grounded. In some embodiments, capacitor C22 as floating prevention unit 40 is, but not limited thereto, a film capacitor, and it may be other types of capacitors including a ceramic capacitor.

In the embodiment of FIG. 4, current limiting unit 30 serves to provide the current output from the rectifying diode D22 with its magnitude limited to a predetermined level as an input to the smoothing electrolytic capacitor C21. To this end, current limiting unit 30 limits a current value inputted from the rectifying diode D22 from exceeding the maximum allowable ripple current value of electrolytic capacitor C21 and provides the limited current as an input to electrolytic capacitor C21.

In the embodiment of FIG. 4, current limiting unit 30 is configured to include a variable resistor operative to keep its output current from exceeding the maximum allowable ripple current of electrolytic capacitor C21, and load 1 includes an electrical load such as an LED, a charger, a refrigerator, an electric washing machine, etc.

Further, simply adding current limiting unit 30 to the embodiment of FIG. 4 may be vulnerable to an interruption to current limiting unit 30 that leads to floating of the output of the rectifying diode D22 and in turn a failure of feedback function which is necessary for switch SW21 to perform the on/off switching. As a preventive measure, film capacitor C22 may be inserted between the output terminal of the rectifying diode D22 and the input terminal of current limiting unit 30 to prevent the maloperation.

FIG. 5 is a circuit diagram of an electrical load driving device according to yet another embodiment of the present disclosure, which is applied to a flyback SMPS.

In the circuit of FIG. 5, the configuration of a full-wave bridge rectifier 50, a transformer T51, a switch SW51 and a rectifying diode D51 is the same as that of a conventional flyback SMPS, and therefore the detailed description thereof is omitted.

Further to the conventional flyback SMPS circuit, the electrical load driving device shown in FIG. 5 includes a current limiting unit 30 between the input terminal of capacitor C51 serving as a smoothing unit and the output terminal of diode D51 serving as a rectifying unit for the current in the output path, and includes a capacitor C52 that serves as a floating prevention unit 40 between the output terminal of the rectifying diode D51 and the input terminal of current limiting unit 30.

Capacitor C52 in the circuit of FIG. 5 serves to temporarily store energy while preventing the output of the diode D51 from floating, when current limiting unit 30 is interrupted. Such capacitor C52 has one end connected between the output terminal of diode D51 and the input terminal of current limiting unit 30, and the other end grounded. In some embodiments, capacitor C52 as the floating prevention unit is, but not limited thereto, a film capacitor, and it may be a ceramic capacitor among others.

In the embodiment of FIG. 5, current limiting unit 30 serves to provide the current output from diode D51 as the rectifying unit with its magnitude limited to a predetermined level as an input to electrolytic capacitor C51 as the smoothing unit. To this end, current limiting unit 30 limits a current value inputted from the rectifying diode D51 from exceeding the maximum allowable ripple current value of electrolytic capacitor C51 and provides the limited current as an input to electrolytic capacitor C51.

In the embodiment of FIG. 5, current limiting unit 30 is configured to include a variable resistor operative to keep its output current from exceeding the maximum allowable ripple current of electrolytic capacitor C51, and load 1 includes an electrical load such as an LED, a charger, a refrigerator, an electric washing machine, etc.

Further, a simple addition of current limiting unit 30 to the embodiment of FIG. 5 may be vulnerable to an interruption to current limiting unit 30 that leads to floating of the output of rectifying diode D51 and in turn a failure of feedback function which is necessary for switch SW51 to perform the on/off switching. As a preventive measure, film capacitor C52 may be inserted between the output terminal of the rectifying diode D51 and the input terminal of current limiting unit 30 to prevent the maloperation.

Typically, electrolytic capacitors such as capacitors C11, C21 and C51 which are provided in FIGS. 3-5 are small in size and low in price, whereas they have smaller allowable ripple current value and a short life at high temperatures. For example, some electrolytic capacitors manufactured by Samwha Capacitor Co., Ltd. have allowable ripple current of about 280 mA at 450V, 22 ρF and 105 degrees Celsius with an operational lifetime of 10000 Hr.

In contrast, film capacitors such as capacitors C12, C22, C52 which are provided in FIGS. 3-5 have very large allowable ripple current, good high-temperature properties with a rated life of about 100,000 to 350,000 long hours of operation with an available self-healing function for filling up cracks from possible damages due to an external voltage spark. For example, electrolytic capacitor V-735P manufactured by Vishay has allowable ripple current of about 30 A at 1~30 uF and 105 degrees Celsius.

However, when compared to the electrolytic capacitors, the film capacitors have been prohibitively bulky and costly, and they were considered inadequate to fit in the intricate requirements of compactness and price terms for LED bulbs and lighting. Notwithstanding, some embodiments of the present disclosure utilize electrolytic capacitors C11, C21, C51 as default for the purpose of smoothing at the output side as in FIGS. 3-5, and a small film capacitor reduced by 1/10 to 1/20 the volume of existing film capacitor for the purpose of preventing floating of rectifying diodes D11, D22 and D51 when current limiting unit 30 is interrupted. Thereby, some embodiments of the present disclosure satisfy the small size requirement of the lighting equipment and providing an active power supply circuit for driving the LED with a lifetime of the order of approximately 50,000 hours to 100,000 hours or more.

Figure 6:
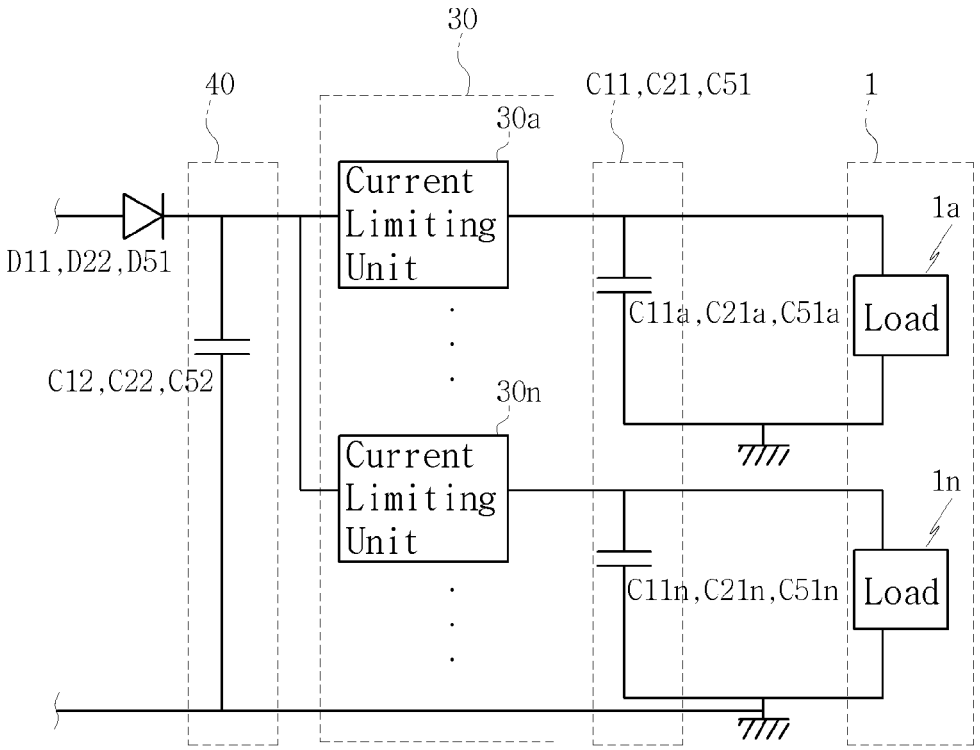
FIG. 6 is a circuit diagram of an electrical load driving device according to yet another embodiment of the present disclosure.

FIG. 6 is a circuit diagram of an electrical load driving device according to yet another embodiment of the present disclosure, illustrating a string of multiple LEDs installed on an example consolidation of the circuits of FIGS. 3-5. Here, current limiting unit 30 of FIGS. 3-5 includes one or more current limiting units 30*a*-30*n* connected in parallel with each other at the output terminals of rectifying diodes D11, D22 and D51 as the rectifying unit. Electrolytic capacitors C11, C21 and C51 as the smoothing unit of FIGS. 3-5 include one or more smoothing units C11*a*-C11*n*, C21*a*-C21*n* and C51*a*-C51*n* respectively connected to the one or more current limiting units 30*a*-30*n*. In addition, load 1 includes one or more loads 1*a*-1*n* respectively connected to the one or more smoothing units C11*a*-C11*n*, C21*a*-C21*n* and C51*a*-C51*n*.

INDUSTRIAL APPLICABILITY

As described above, according to some embodiments of the present disclosure, the electrical load driving device allows mounting of LEDs together with the SMPS or such power supply circuit even in a relatively smaller lighting equipment while preventing a ripple current runaway of an electrolytic capacitor due to thermal runaway of the LED and power supply components exhibiting changes in their thermal properties caused by their own generation of heat, so as to prolong the lifespan of the SMPS beyond the 50,000 hours to 100,000 hours of the LED life and thereby provide reliability improvement to LED lighting equipment that utilizes the electrolytic capacitor in the SMPS.

The invention claimed is:

1. An electrical load driving device including an SMPS (switching mode power supply), the electrical load driving device comprising:

a rectifying unit configured to rectify a current on an output path of the SMPS;

a current limiting unit configured to limit the current output from the rectifying unit to a value equal to or less than a predetermined magnitude;

a smoothing unit configured to supply a power to a load by smoothing a current output from the current limiting unit, wherein the smoothing unit is connected in parallel with the load; and a floating prevention unit installed between an output terminal of the rectifying unit and an input terminal of the current limiting unit and configured to prevent an output of the rectifying unit from floating when the current limiting unit is interrupted, wherein the smoothing unit includes an electrolytic capacitor and the floating prevention unit includes a film capacitor, wherein the current limiting unit is connected in series between the output terminal of the rectifying unit and an input terminal of the smoothing unit, the film capacitor has one terminal connected to a common junction of the output terminal of the rectifying unit and the input terminal of the current limiting unit, and the other terminal grounded and connected in parallel with the electrolytic capacitor, and wherein the predetermined magnitude includes a maximum allowable ripple current of the electrolytic capacitor, as an input to the electrolytic capacitor of the smoothing unit.

2. The electrical load driving device of claim 1, wherein the current limiting unit comprises two or more current limiting units connected in parallel with each other at the output terminal of the rectifying unit, the smoothing unit comprises two or more smoothing units respectively connected to the two or more current limiting units, and the load comprises two or more loads respectively connected to the two or more smoothing units.

3. The electrical load driving device of claim 1, wherein the load is an LED.

4. The electrical load driving device of claim 1, wherein the predetermined magnitude comprises a maximum allowable ripple current value of the electrolytic capacitor.

5. The electrical load driving device of claim 4, wherein the current limiting unit comprises a variable resistor operative to keep the current output from exceeding the maximum allowable ripple current of the electrolytic capacitor.

* * * * *